United States Patent [19]

Mayer et al.

[11] 4,163,879

[45] Aug. 7, 1979

[54] SELECTOR SWITCH

[75] Inventors: Robert W. Mayer, Hackettstown; Adam Smorzaniuk, West Millington, both of N.J.

[73] Assignee: Amerace Corporation, New York, N.Y.

[21] Appl. No.: 856,728

[22] Filed: Dec. 1, 1977

[51] Int. Cl.[2] ..... H01H 19/58

[52] U.S. Cl. ..... 200/11 TW; 200/11 DA; 200/252; 200/264; 200/279; 200/292

[58] Field of Search ..... 200/11 R, 11 DA, 11 G, 200/11 J, 11 K, 11 TW, 252, 253, 264, 292, 336, 279, 265, 155; 338/100, 150, 152, 162

[56] References Cited

U.S. PATENT DOCUMENTS

| | | | |
|---|---|---|---|
| 3,366,751 | 1/1968 | Capellari | 200/11 TW |
| 3,531,799 | 9/1970 | Rendler | 200/253 X |
| 3,903,383 | 9/1975 | Marker | 200/11 TW |

OTHER PUBLICATIONS

AMP, Inc.; "Switches and Relays"; Data Sheet No. 76-408; 2 pp.; 01 Aug. 1976.

*Primary Examiner*—James R. Scott

*Attorney, Agent, or Firm*—S. Michael Bender; Arthur Jacob

[57] ABSTRACT

A selector switch of the type having a thumbwheel selector journalled for rotation in a frame for selecting any one of a plurality of interconnections among external circuits to be connected to electrical contacts mounted in the frame, the selector including a first part of dielectric material and a second part of non-metallic electrically conductive material carried by the first part and having a pattern configured in accordance with a predetermined code and contacted by various ones of the electrical contacts in different positions of the selector to connect and disconnect the contacts in accordance with the pattern of conductive material so as to selectively close and open the interconnections among the external circuits.

19 Claims, 8 Drawing Figures

SELECTOR SWITCH

BACKGROUND OF THE INVENTION

1. Field of the Invention

The present invention relates generally to selector switches and pertains, more specifically, to a selector switch of the type having multiple poles, or contacts, among which connections are made in accordance with the selective positioning of a coded element of the switch.

2. Description of the Prior Art

Conventional selector switches, such as currently available thumbwheel selector switches, employ coded elements which usually include patterns of metallic conductive material carried upon a substrate for effecting the desired interconnections among the poles of the switch. The patterns are constructed in the form of conventional "printed circuits" in which the coded pattern is etched on a printed circuit board. Usually, the metallic circuit portions are plated with gold to provide an oxide-free contact surface for electrical switching of low level signals, and for low contact resistance. The etching and plating operations required to fabricate printed circuit boards for these switches are relatively expensive and time-consuming.

SUMMARY OF THE INVENTION

It is an object of the present invention to provide a selector switch in which a coded element includes a pattern of non-metallic electrically conductive material for effecting the desired interconnections among the various poles of the switch.

Another object of the invention is to provide a selector switch of the type described in which the selector includes a pattern of non-metallic electrically conductive material integral with a dielectric material in a rotor journalled for rotation among selected positions for effecting the desired interconnections among external circuits connected to the switch.

Still another object of the invention is to provide a selector switch of the type described and in which the selector is constructed of integrally molded first and second parts, the first part being a dielectric synthetic resin material and the second part being a conductive synthetic resin material molded in a pattern configured in accordance with the particular code desired in the coded element of the switch.

A further object of the invention is to provide a selector switch of the type described and in which the poles, or contacts, are in the form of contact pins having a configuration, dimensions and arrangement suitable for mounting the switch in conventional sockets or receptacles, or directly onto printed circuit boards, to connect the switch to external circuits.

A still further object of the invention is to provide a selector switch of the type described which is accurate and reliable and will perform effectively over a long period of use.

Still another object of the invention is to provide a selector switch of the type described which is economical to fabricate utilizing current manufacturing techniques, and is constructed of relatively low-cost materials without sacrificing reliable operation.

The above objects, as well as still further objects and advantages, are attained by the present invention, which may be described briefly as a selector switch for selecting any one of a plurality of interconnections among external circuits to be connected to the switch, the interconnections being made in accordance with a predetermined code, the selector switch comprising a frame, a selector mounted for movement relative to the frame to any one of a plurality of fixed relative positions, the selector including a first part of dielectric material and a second part of non-metallic electrically conductive material, the selector having a contact face and the second part including a pattern extending along the contact face of the selector, the pattern being configured in accordance with the predetermined code, and a plurality of electrical contacts affixed to the frame, the contacts having circuit connection portions for connection to the external circuits, and contact surfaces juxtaposed with the contact face of the selector such that movement of the selector relative to the frame to one of the fixed positions will electrically connect and disconnect the contacts in accordance with the pattern of the conductive material at the contact face of the selector to close and open the interconnections among the external circuits.

BRIEF DESCRIPTION OF THE DRAWING

The invention will be more fully understood, while still further objects and advantages will become apparent, in the following detailed description of preferred embodiments of the invention illustrated in the accompanying drawing, in which.

DESCRIPTION OF THE PREFERRED EMBODIMENTS

Figure 1:
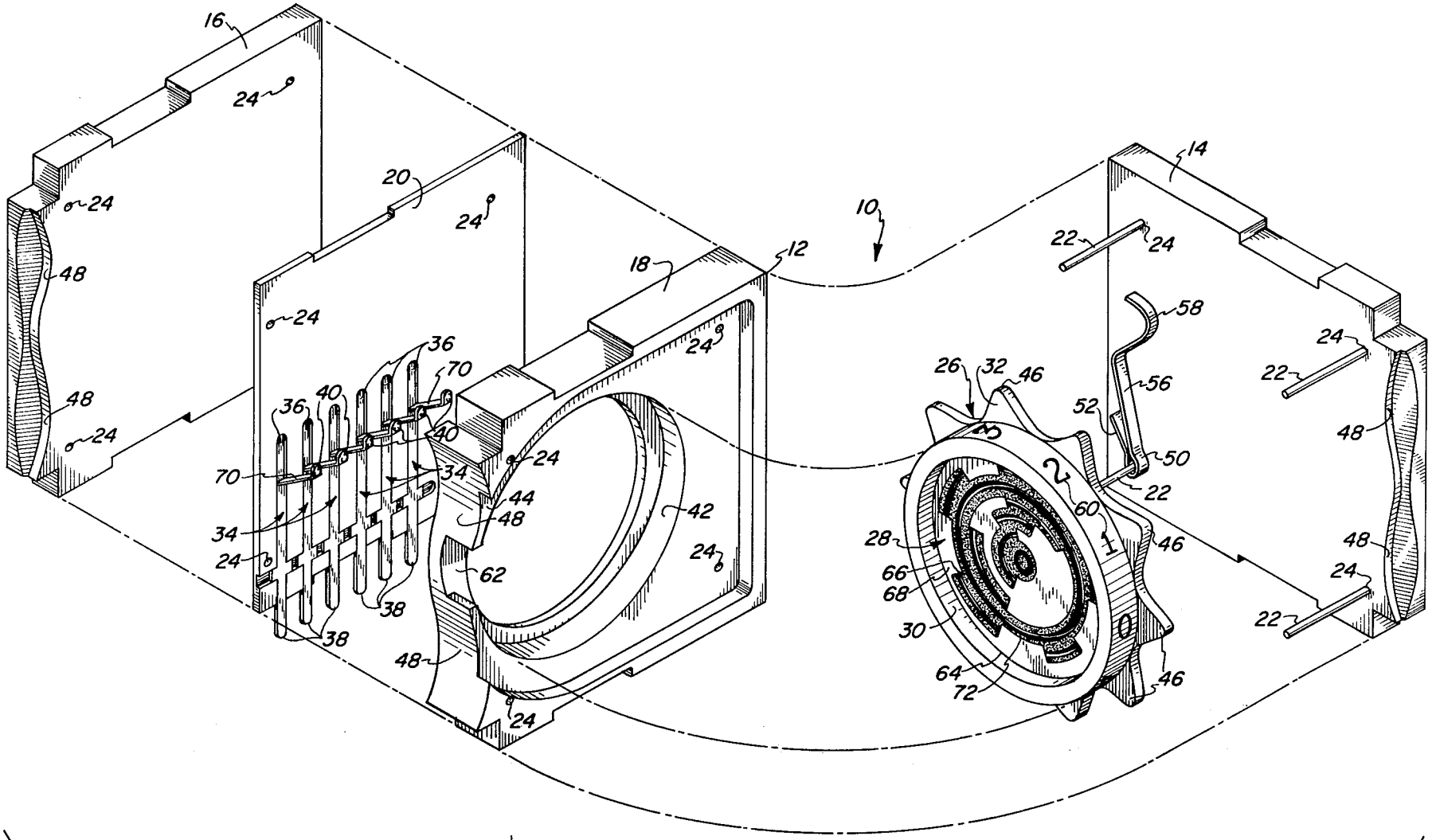
FIG. 1 is an exploded perspective view of a thumbwheel selector switch constructed in accordance with the invention.

Referring now to the drawing, and especially to FIG. 1 thereof, a selector switch constructed in accordance with the invention is illustrated in the form of a thumbwheel selector switch 10. Switch 10 has a frame 12 which includes opposite side members 14 and 16, a central body member 18 and a contact plate 20, all located relative to one another and secured in assembled relationship by fasteners in the form of rods 22 fitted into complementary holes 24 in the respective component parts.

A selector, shown in the form of a rotor 26, has a disk-like central portion 28, an axially extending skirt 30 and a radially projecting thumbwheel 32. The contact plate 20 is dielectric and carries a plurality of electrical contacts 34 affixed within complementary recesses 36 in the plate 20 and electrically insulated from one another. Contacts 34 have circuit connection portions, or poles, in the form of connector pins 38 projecting outwardly from plate 20, and contact surfaces 40 at the ends of the contacts opposite the connector pins 38.

Figure 2:
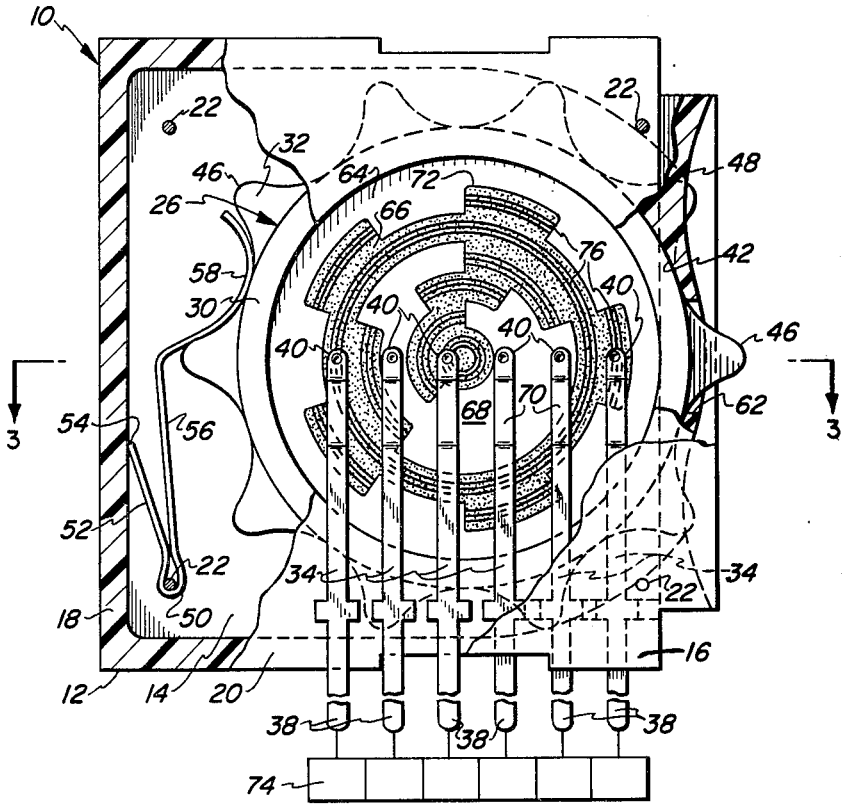
FIG. 2 is an elevational view of the switch in assembled configuration with portions cut away to reveal internal component parts.
Figure 3:
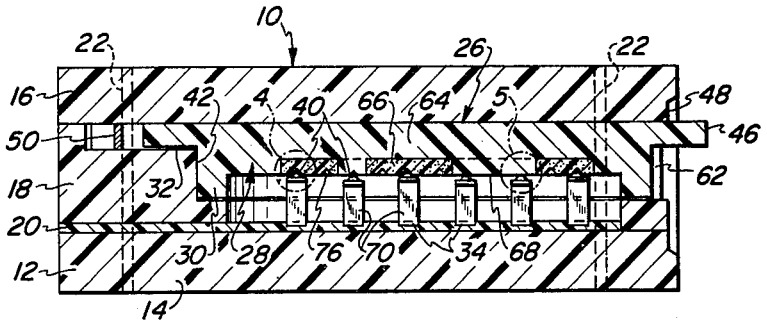
FIG. 3 is a cross-sectional view taken along line 3—3 of FIG. 2.

Turning now to FIGS. 2 and 3, as well as to FIG. 1, rotor 26 is journalled for rotation in frame 12 by virtue of skirt 30 being received within a complementary cylindrical race 42 within body member 18. A slot 44 in the body member 18 enables the individual projections 46 of the thumbwheel 32 to extend through the body member 18, and contoured recesses 48 in the body member 18 and the side members 14 and 16 permit access to the outwardly extending projections 46 by an operator's thumb such that thumbwheel 32 and the rotor 26 may be rotated by pushing the operator's thumb against each projection 46 as the projections arrive at slot 44. A detent spring 50 is mounted upon one of the rods 22 and has a first leg 52 which bears against the body member 18 at 54 and a second leg 56 which carries a detent element 58. Detent element 58 engages the thumbwheel 32 between adjacent projections 46 to define fixed positions among which the rotor 26 can be indexed. Each position of the rotor is indicated by indicia in the form of characters 60 carried by skirt 30 and made visible through a window 62 in the body member 18. Thus, each position has an associated projection 46 at the slot 44 and an associated character 60 at window 62.

Rotor 26 is constructed of first and second parts shown in the form of elements 64 and 66. The first element 64 is fabricated of a dielectric material, preferably in the form of a synthetic resin material. The second element 66 is constructed of a non-metallic electrically conductive material, also preferably in the form of a synthetic resin material. Second element 66 is shown embedded in first element 64 with both elements lying in a common surface at a contact face 68 of the rotor 26. Contact surfaces 40 of electrical contacts 34 are urged against contact face 68 of the rotor 26 by the resilient biasing force of each arm 70 of each electrical contact 34, contacts 34 being of resiliently deflectable metallic construction.

Second element 66 presents a pattern 72 of conductive material at the contact face 68. Pattern 72 is configured in accordance with a predetermined code so that for each position of rotor 26, certain of the electrical contacts 34 are in contact with the second element 66 at the contact face 68 and therefore are in electrical contact with one another. Others of the electrical contacts 34 are in contact with the first element 64 at the contact face 68 and therefore are not in electrical contact with any other contacts 34. In this manner, each position of the rotor 26 provides a corresponding combination of interconnections detectable at the connector pins 38. External circuits 74 operate in response to the coded combination of interconnections to actuate further devices in accordance with the selection made at switch 10.

The two-part construction of rotor 26 enables the use of simplified techniques for the manufacture of the rotor. For example, elements 64 and 66 can be molded of thermoplastics in a two-shot molding operation to establish an integrally molded rotor 26. Materials for elements 64 and 66 can be chosen for optimum properties in each element. Thus, element 64 should have good dielectric properties and should be solvent and heat-resistant. Element 66 also should be solvent and heat-resistant, but must be electrically conductive. Heat resistance is required to withstand the heat of soldering where connections are made to pins 38 by soldering. Solvent resistance is required to resist solvents employed in cleaning the soldered connections. Suitable materials for elements 64 and 66 are polycarbonates, such as LEXAN. A dielectric polycarbonate can be selected for element 64, while a conductive polycarbonate is selected for element 66. Polyesters, such as VALOX, are also suitable and offer the added advantages of being self-lubricating. In each instance the non-metallic conductive element 66 resists oxidation and therefore requires no special treatment, such as plating, to provide an effective electrical contact over long periods of use. Various configurations for pattern 72 are easily fabricated to provide for different codes.

Figure 4:
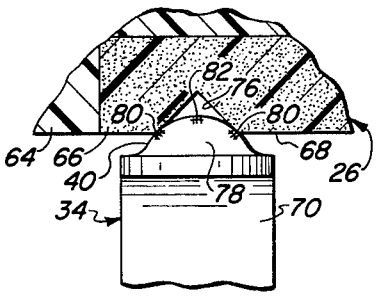
FIG. 4 is an enlarged fragmentary view of a portion of FIG. 3, as indicated in the circled portion of FIG. 3.

In order to assure effective electrical contact at selected positions between the contact surfaces 40 of the appropriate electrical contacts 34 and the conductive element 66 of rotor 26, each contact surface 40 is aligned with a groove 76 in element 66, each groove extending along a path of travel followed by the relative movement of rotor 26 and contacts 34. As best seen in FIG. 4, each groove 76 has a V-shaped cross-sectional configuration. Contact surfaces 40 are each provided with a convex surface contour in the form of a semi-spherical surface at 78 so that two areas 80 of contact are provided for each contact surface 40. In this manner, minor irregularities in the contact face 68 will not affect the establishment of effective electrical contact between a contact surface 40 and second element 66.

Figure 5:
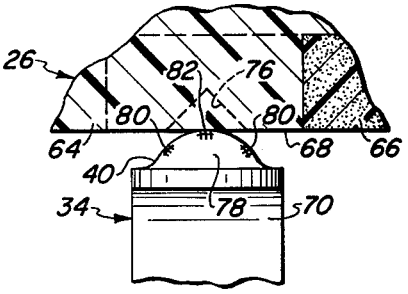
FIG. 5 is an enlarged fragmentary view of another portion of FIG. 3, as indicated in the circled portion of FIG. 3.

Because of the configuration of pattern 72 on contact face 68, at least some of the contact surfaces 40 alternately engage element 64 and element 66 in the various positions of rotor 26. The nature of the conductive materials chosen for element 66, i.e., soft, particulate conductive materials mixed within a matrix of the basic thermoplastic material, can cause the areas 80 of contact surfaces 40 to become coated with conductive materials from element 66. Deleterious effects could occur, should such conductive materials be tracked onto the dielectric areas of contact face 68 provided by element 64. In order to avoid such tracking, the grooves 76 are discontinued at the element 64 so that grooves 76 appear only in element 66. Thus, the path of travel of at least some of the contact surfaces 40 over the contact face 68 includes first segments lying along element 64 and second segments lying along element 66, with the grooves 76 extending only along those segments lying along element 66. The difference in elevation of the first and second segments of each path of travel results in different portions of the corresponding contact surface 40 coming into contact with the first element 64 and the second element 66. As best seen in FIGS. 4 and 5, when contact surface 40 is in a groove 76, areas 80 are in contact with element 66. When contact surface 40 rises out of groove 76 to ride upon element 64, a different area 82 of contact surface 40 engages element 64. Thus, any conductive materials which may have been deposited on areas 80 of contact surface 40 will not come into contact with element 64 and will not be tracked onto the contact face at element 64. The resilience of contacts 34 enables the contact surfaces 40 to ride in and out of the groove segments along each path of travel.

In the preferred construction, the contact face 68 is generally planar and all of the contacts 34 may be of identical construction. The contacts 34 extend parallel to one another and project beyond the frame 12 to provide the connector pins 38. Connector pins 38 are arranged in an array which includes a row of pins 38 spaced equidistant from one another and suitable for direct insertion into a standard socket or receptacle, such as the now ubiquitous IC socket. Pins 38 can be constructed in various configurations and dimensions and arranged to be inserted directly into a printed circuit board, if desired. It is a relatively simple matter to re-orient contact plate 20 so that the pins 38 will project from the frame in another direction, thereby enabling the switch 10 to be adapted for mounting in various orientations.

Figure 6:
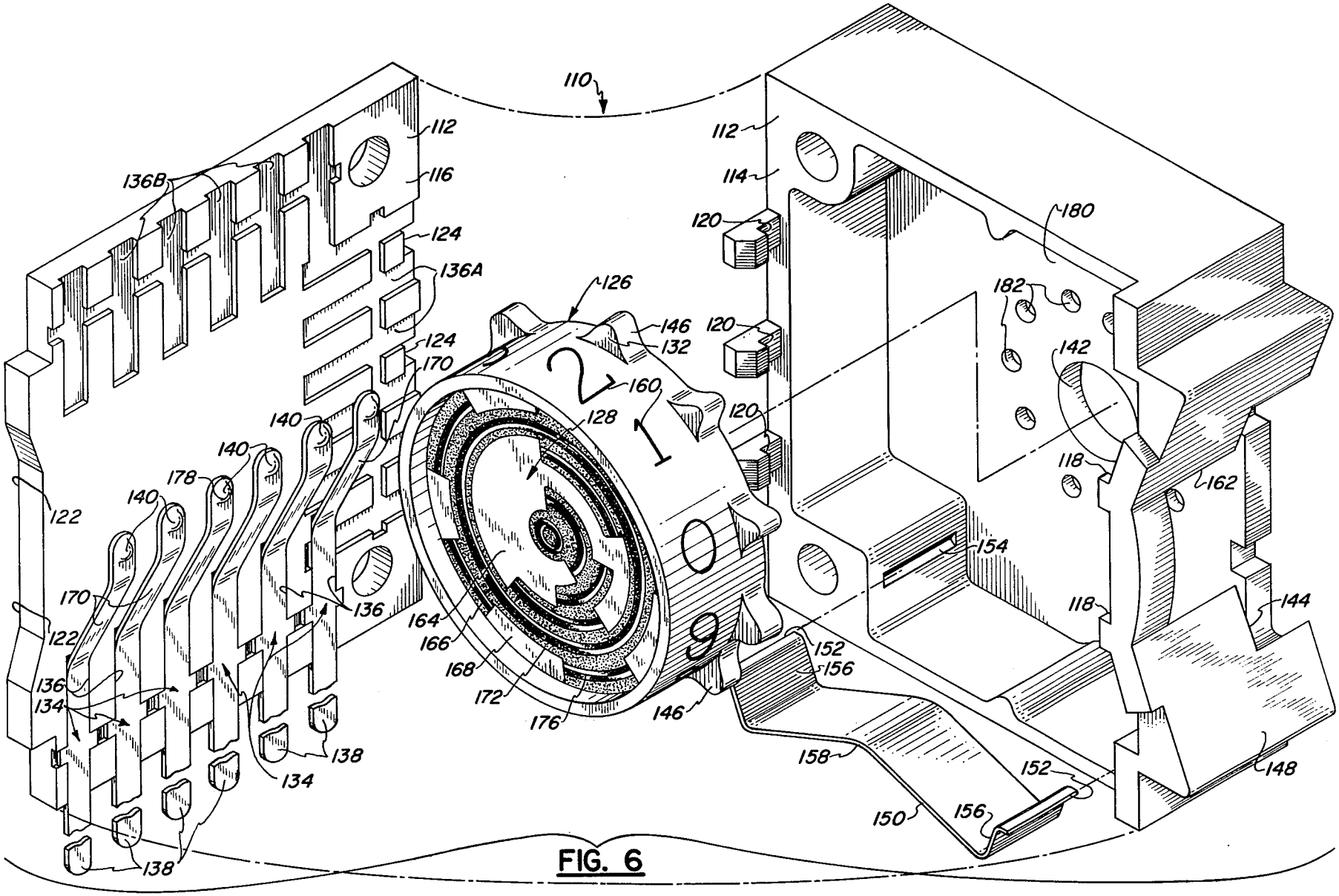
FIG. 6 is an exploded perspective view of another thumbwheel selector switch constructed in accordance with the invention.
Figure 7:
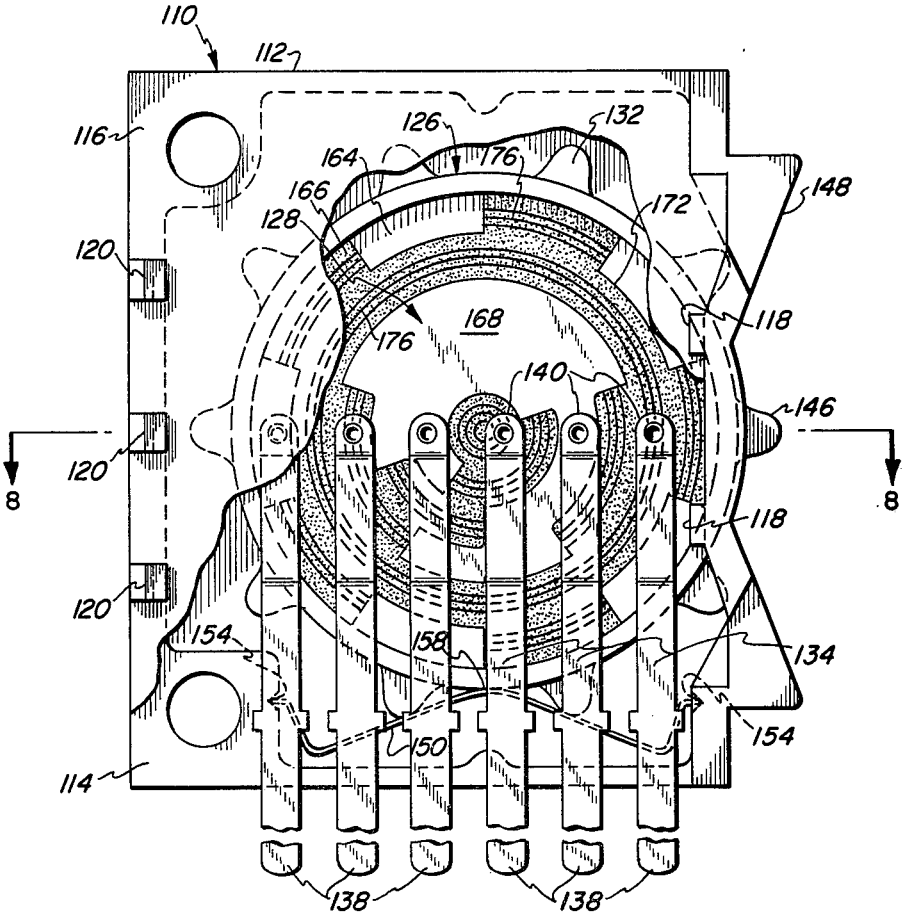
FIG. 7 is an elevational view of the switch of FIG. 6 in assembled configuration with portions cut away to reveal internal component parts.
Figure 8:
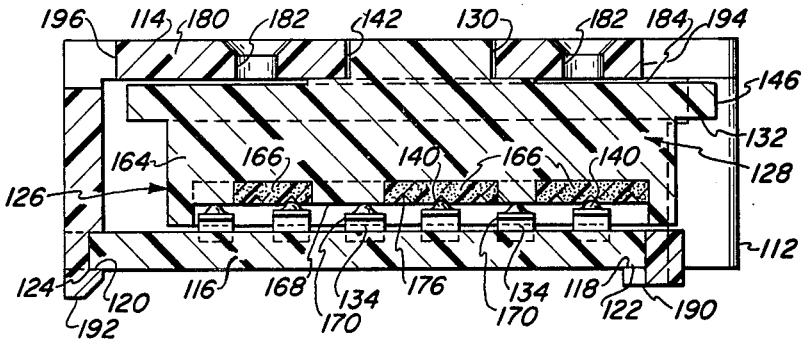
FIG. 8 is a cross-sectional view taken along line 8—8 of FIG. 7.

Another embodiment of the present invention is illustrated in FIGS. 6 through 8 in the form of a thumbwheel selector switch 110. Switch 110 has a frame 112 which includes members 114 and 116, located relative to one another and secured together in assembled relationship by shoulders 118 and resiliently deflectable latches 120 which are integral with member 114 and engage corresponding portions 122 and 124 of member 116 to secure the members together.

A selector, shown in the form of a rotor 126 has a disk-like central portion 128, an axially extending stub shaft 130 and a radially projecting thumbwheel 132. A plurality of electrical contacts 134 are affixed within complementary recesses 136 in member 116, which is constructed of a dielectric material so that the contacts 134 are electrically insulated from one another. Connector pins 138 are unitary with the contacts at one end thereof and project outwardly from member 116, while contact surfaces 140 are provided at the other ends of the contacts. Member 116 of frame 112 of switch 110 includes alternate sets of recesses 136A and 136B so that the electrical contacts 134 may be affixed within any selected set of recesses 136, 136A or 136B to provide connector pins 138 projecting from the top, rear or bottom of the switch 110.

Rotor 126 is journalled for rotation in frame 112 by virtue of stub shaft 130 being received within a complementary cylindrical bore 142 within member 114. A slot 144 in member 114 enables the individual projections 146 of the thumbwheel 132 to extend through the member 114, and the contour of front surface 148 of member 114 permits access to the outwardly extending projections 146 by an operator's thumb to enable rotation of the rotor 126. A detent spring 150 is mounted in member 114 by means of end tabs 152 which are received within grooves 154 in member 114. End tabs 152 are located on legs 156 of detent spring 150, and a detent element 158 is located between the legs 156. Detent element 158 engages the thumbwheel 132 between adjacent projections 146 to define fixed positions for rotor 126. Each position of the rotor is denoted by indicia in the form characters 160 made visible through a window 162 in the member 114.

Rotor 126 is constructed of first and second parts shown in the form of elements 164 and 166. As in the earlier-described embodiment, the first element 164 is fabricated of a dielectric material and the second element 166 is constructed of a nonmetallic electrically conductive material, both elements 164 and 166 preferably being constructed of a synthetic resin material. Second element 166 is shown embedded in first element 164 with both elements lying in a common surface at a contact face 168 of the rotor 126. The contact surfaces 140 of electrical contacts 134 are urged against contact face 168 by the resilient biasing force of each arm 170 of each electrical contact 134.

Second element 166 presents a pattern 172 of conductive material at contact face 168, the pattern 172 being configured in accordance with a predetermined code, as described in connection with switch 10. Each contact surface 140 is aligned with a groove 176 in element 166, each groove having a V-shaped cross-sectional configuration. Contact surfaces 140 are provided with a convex surface contour at 178 for the purposes explained in connection with the earlier-described embodiment.

Wall 180 of member 114 is provided with a plurality of apertures 182 which are aligned with a C-shaped recess 184 in rotor 126. A pin (not shown) may be placed within any one selected aperture 182 to enter recess 184 and provide a stop at a selected position of rotor 126, in a now well-known manner.

It is noted that shoulder 118 and latches 120 of member 114 include outwardly-projecting portions 190 and 192, while complementary slots 194 and 196 are provided at the opposite side of member 114. In this manner, like switches 110 can be located side-by-side in nested relationship in an installation, with portions 190 and 192 entering slots 194 and 196, respectively.

It is to be understood that the above detailed description of preferred embodiments of the invention are provided by way of example only. Various details of design and construction may be modified without departing from the true spirit and scope of the invention, as set forth in the appended claims.

We claim:

1. A selector switch for selecting any one of a plurality of interconnections among external circuits to be connected to the switch, the interconnections being made in accordance with a predetermined code, said selector switch comprising:

a frame;

a selector mounted for movement relative to the frame to any one of a plurality of fixed relative positions;

the selector including a first part of dielectric material and a second part of non-metallic electrically conductive material, the selector having a contact face and the second part including a pattern extending along the contact face of the selector, the pattern being configured in accordance with the predetermined code; and a plurality of electrical contacts affixed to the frame, the contacts having circuit connection portions for connection to the external circuits, and contact surfaces juxtaposed with the contact face of the selector such that movement of the selector relative to the frame to one of said fixed positions will electrically connect and disconnect the contacts in accordance with the pattern of the conductive material at the contact face of the selector to close and open the interconnections among the external circuits.

2. The invention of claim 1 wherein the second part of the selector is an electrically conductive synthetic resin material.

3. The invention of claim 2 wherein the first part of the selector is a dielectric synthetic resin material.

4. The invention of claim 1 wherein the first part of the selector is a dielectric synthetic resin material.

5. The invention of claim 4 wherein the second part of the selector is an electrically conductive synthetic resin material molded integrally with the first part of the selector.

6. The invention of claim 5 wherein the material of each of the first and second parts is a thermoplastic synthetic resin material.

7. The invention of claim 1 wherein each contact surface is aligned with a path of travel on the contact face of the selector, each path of travel including first segments lying along the first part of the selector and second segments lying along the second part of the selector, the elevation of the first segments differing from the elevation of the second segments, and each contact surface has a contour enabling first portions only of the contact surface to engage the first segments and second portions only of the contact surface to engage the second segments.

8. The invention of claim 7 including means resiliently biasing the contact surfaces into engagement with the contact face of the selector along each respective path of travel.

9. The invention of claim 8 wherein the second part includes grooves lying along the path of travel on the contact face of the selector, and the contact surfaces are convex so as to enter the grooves.

10. The invention of claim 9 wherein the grooves are V-shaped in cross-section and the contact surfaces are generally semi-spherical.

11. The invention of claim 1 wherein the selector includes a rotor journalled in the frame rotation relative to the frame.

12. The invention of claim 11 wherein the circuit connection portions of the electrical contacts project from the frame and are arranged in a prescribed array.

13. The invention of claim 12 wherein the circuit connection portions comprise connector pins and the prescribed array includes a row of connector pins spaced equidistant from one another.

14. The invention of claim 12 wherein the contact face of the selector is generally planar and the electrical contacts extend generally parallel to one anotherand parallel to the contact face.

15. The invention of claim 11 wherein the rotor is molded of synthetic resin materials, the first part being molded of a dielectric synthetic resin material and the second part being molded of an electrically conductive synthetic resin material, the first and second parts being molded integral with one another.

16. The invention of claim 15 wherein each contact surface is aligned with a path of travel on the contact face of the selector, each path of travel including first segments lying along the first part of the selector and second segments lying along the second part of the selector, the elevation of the first segments differing from the elevation of the second segments, and each contact surface has a contour enabling first portions only of the contact surface to engage the first segments and second portions only of the contact surface to engage the second segments.

17. The invention of claim 16 including means resiliently biasing the contact surfaces into engagement with the contact face of the selector along each respective path of travel.

18. The invention of claim 17 wherein the second part includes grooves lying along the path of travel on the contact face of the selector, and the contact surfaces are convex so as to enter the grooves.

19. The invention of claim 18 wherein the grooves are V-shaped in cross-section and the contact surfaces are generally semi-spherical.

* * * * *